United States Patent [19]

Béringer et al.

[11] 4,058,129

[45] Nov. 15, 1977

[54] CONTINUOUS PROCESS FOR THE PRODUCTION OF A PASTE WITH ADDITIVES WHICH CAN BE FORMED INTO A SMOKABLE MATERIAL

[75] Inventors: Monique Béringer, Saint Louis, France; Heinz Spörri, Egg, Switzerland

[73] Assignee: Fabriques de Tabac Reunies S.A., Neuchatel, Switzerland

[21] Appl. No.: 638,951

[22] Filed: Dec. 8, 1975

[30] Foreign Application Priority Data

Mar. 27, 1975 Luxembourg ..... 72156
Mar. 27, 1975 Luxembourg ..... 72157

[51] Int. Cl.[2] ..... A24B 3/14
[52] U.S. Cl. ..... 131/140 C
[58] Field of Search ..... 131/17, 140 C, 15; 259/9, 10, 191, 23, 24, 25; 23/295

[56] References Cited

U.S. PATENT DOCUMENTS

| | | | |
|---|---|---|---|
| 2,845,933 | 8/1958 | Samfield et al. | 131/140 C |
| 3,377,139 | 4/1968 | MacGregor et al. | 23/285 |
| 3,396,734 | 8/1968 | Jansson | 131/140 C |
| 3,529,605 | 9/1970 | Beringer et al. | 131/140 C |
| 3,605,757 | 9/1971 | Buchmann et al. | 131/140 C |

*Primary Examiner*—Robert W. Michell
*Assistant Examiner*—V. Millin
*Attorney, Agent, or Firm*—Peter K. Kontler

[57] ABSTRACT

For the production of artificial tobacco from pulverized plant parts, liquid and additives, the liquid is continuously forced, simultaneously with but separate from the powder, into a grinding chamber from which paste is continuously removed to be shaped and dried.

6 Claims, 3 Drawing Figures

CONTINUOUS PROCESS FOR THE PRODUCTION OF A PASTE WITH ADDITIVES WHICH CAN BE FORMED INTO A SMOKABLE MATERIAL

BACKGROUND OF THE DISCLOSURE

The invention relates to a continuous process for the production of a paste with additives which can be formed into a smokable material, in which process a liquid and pulverized plant parts are introduced into one end of a grinding chamber, stirred and ground by grinding tools within the grinding chamber, and removed at the other end of the grinding chamber as a sieved paste.

In processes of this type, the plant parts are ground to their ultimate fineness in a wet state by treating them as carefully as possible in order to avoid a tarry smoke taste. In a well-known process of the initially mentioned type, the pulverized plant parts are first made into a paste with the liquid and the paste won in this manner is then admitted into the grinding chamber.

OBJECTS AND SUMMARY OF THE INVENTION

It is an object of the invention to simplify this well-known process. The invention is characterized in that, owing to constant replacement of grinding stock, the grinding chamber is always filled with grinding stock and that dried and pulverized plant parts are continuously pressed into the grinding stock at one end whereby the dried powder is intimately contacted by the appertaining liquid at the time of its introduction into the grinding stock because the liquid is forced into the grinding stock simultaneously with but separate from the powder and close to the locus or point at which the powder is introduced into the grinding stock.

According to the invention, making a paste from the plant parts before they are introduced into the grinding chamber is neither required nor provided for. The invention also allows the plant parts to be introduced into the grinding stock in a dried state, whereby the grinding procedure in the grinding chamber is simplified. In accordance with the known processes, it is difficult to moisten the dried, pulverized plant parts evenly with the liquid. The invention solves this problem in a very simple way namely, since the grinding stock is constantly circulated one achieves without further effort a thorough moisturization of the incoming dry powder. Moisturization is promoted by the introduction of the liquid very close to the powder, causing the areas of the grinding stock which the plant powder first reaches to be especially moist.

As to the nature of the plant parts, those which are preferred include the threshing refuse of grain, such as straw, bran; chaff of wheat, oats, rice and corn, and the shells and fibers of coconuts, coffee beans and cocoa beans. In addition to such nicotine-free plant parts or instead of them, one can also utilize tobacco plants or parts of tobacco plants or tobacco refuse from the tobacco processing industry.

The liquid can be water or a solution in which the necessary chemical additives and other desired additives can be mixed or dissolved. One can also mix these additives into the finished paste later. As to nature of additives, they include binding agents, for example sodium carboxy methyl cellulose; agents to improve the burning process, such as magnesium formate; softening agents, for example glycerin; substances to enhance the aroma, for example paraffin carbamide.

As a result of the strring procedure, the grinding stock moves past the point where the powder is introduced and carries the moistened powder away. In order to make certain that the admitted liquid invariably reaches each freshly admitted quantity of the powder, it is advisable to press the powder into the grinding chamber close behind the corresponding liquid entrance, as considered in the direction of the stirring motion of the grinding stock which the powder initially reaches.

The improved process can be carried out in the following way: The grinding stock which is under pressure in the grinding chamber and completely fills the grinding chamber is ground and stirred without further additives. The stirring tools rotate at a relatively high speed. Such procedure is advantageous because it allows for the processing of a relatively dry grinding stock to be processed. If it is not important to process an especially dry grinding stock, one can assist the grinding procedure by mixing into the grinding stock grist particles which are so large as to be unable to pass through the sieve proposed to be located at the exit side. Accordingly, the process further comprises introducing into the grinding stock grist particles consisting of a material which does not supply components injurious to health when being smoked, and the fragments of grindings of which, mixed in the paste, are continuously removed from the grinding chamber and are constantly replenished by the introduction of new grist particles into the grinding chamber. The process further comprises forcibly admitting the grist replenishment into the grinding stock close behind the liquid entrance, as considered in the direction of the stirring motion of those parts of the grinding stock which the grist initially reaches. Replenishing the grist close to the point of the liquid entrance guarantees that a dry rubbing together of the grist which reduces the amount of grist grindings and also that local heating through friction which could lead to a tarry taste in the finished product will be avoided.

The necessary capacity of the stirring tool is dependent on the density of the grinding stock. A further development of the invention utilizes this fact and is characterized in that the stirring capacity of the stirrer is continuously measured and in that the grist replenishment is regulated according to the results of that measurement.

The paste leaving the grinding stock is, mixed together with additives, stabilized into a smokable material by means of drying. The necessary additives, such as binding agents, agents to improve the burning process, substances to enhance the aroma, softening agents and the like can be dissolved or levigated into the liquid which is pressed into the grinding stock or they also can be stirred into the paste as it leaves the chamber. Since in order to stabilize the paste, the largest part of the liquid content must be extracted, it is desirable to keep the liquid content as low as possible from the start and in this respect, in order to always operate the continuous process with an optimal liquid content, it is advisable to continuously measure the viscosity of the paste as it leaves the grinding chamber and to regulate the liquid addition according to the results of the viscosity measurement.

In accordance with a well-known process a paste consisting of plant parts, liquid, chemicals and other additives is mixed with small adsorption particles before the paste is shaped into foils and stabilized by drying. The small adsorption particles have the task of adsorbing the injurious substances which accumulate in the smoke during smoking. They are especially effective because they are located in the smokable product at the point at which the injurious substances caused by the advancing flame enter the smoke. If these injurious substances are retained by the adsorption particles, they will consequently become a direct part of the burning area and be burned as innocuous substances.

The invention makes it possible in a simple manner to produce a product mixed with small adsorption particles whereby adsorbent grist is introduced into the grinding stock and whereby adsorption particles are produced as a by-product through the conveyance of the grist through the grinding chamber and are mixed into the resultant paste.

In this manner, the grindings, which are unavoidable in the grinding procedure with grist, are used as adsorption particles, as far as they consist of adsorbent material. It is especially advantageous that the adsorption particles won through abrasion are intimately mixed with the paste without further effort. The invention makes it possible to utilize the unavoidable grist abrasion and does not necessitate an additional working motion to mix in the adsorption particles.

If the amount of grindings from the adsorbent grist is greater than the admixture of adsorption particles desired in the finished paste, one can then easily counteract this by introducing a portion of nonadsorbent grist. Although the grindings of this grist also enter the paste, they cause no adsorption.

Utilizing the above mentioned possible measures, the process can be carried out continuously whereby adsorbent grist mixed with nonadsorbent grist is used in the grinding stock and the grist grindings are continuously replenished and at the same time the total amount of the replenishment is apportioned depending on the capacity expended for the stirring, and if the capacity is too small the amount is to be increased and vice versa. Furthermore the admixture rate of adsorbent grist in the grist mixture is apportioned depending on the amount of adsorption particles in the paste. If the amount of adsorption particles is too small, the rate is to be increased. The invention makes use of the fact that a loss of grindings necessitating a replenishment of grist is recognizable by a drop of the resistance to stirring. For this purpose, one only needs to continuously measure the output capacity of the stirrer's motor. The amount of adsorption particles in the paste can be readily ascertained from the amount of adsorbent grist being continuously added. As soon as the starting phase has been surmounted and a state of equilibrium in the grist mixture has been established, the amount of adsorbent material which leaves the mill in the form of adsorption particles mixed into the paste is identical with the amount of adsorbent material introduced during the same span of time into the mill in the form of grist. Therefore, one can continuously determine the amount of adsorption particles in the finished product by continuously measuring the amount of the replenishment of adsorbent grist.

Suitable grist of adsorbent material includes magnesium silicate, such as sepiolite; diatomite, zeolite, verniculite or hard ceramic such as porcelain. In addition, pebble flint can be used as a grist of adsorbent material.

Suitable grist of nonadsorbent material include glass, steel, molybdenum and corundum.

A stirrer crushing mill for the production of a paste with additives which can be formed into a smokable material comprises a stationary grinding chamber in which the grinding stock is interfused by a rotating stirrer propelled by an external drive and which extends lengthwise in the direction of the axis of the stirrer and crosswise so that its cross-section is circular. The chamber is provided with an outlet at the other end and contains a sieve for the paste. Said mill is characterized in accordance with the invention in that the grinding container is closed at its inlet end by a removable cover and in that at least one supply conduit for the powder and one for the liquid communicate with the grinding chamber close to the cover. With respect to the direction of rotation, the conduits are located close behind one another and in a restricted axial range with the supply conduit for the liquid located ahead of the supply conduit for the powder.

If the grinding is to be carried out with the addition of grist, an additional supply conduit for the grist replenishment is provided close to the cover and communicates with the grinding chamber.

The crushing mill can be opened by removing the cover for cleaning and maintenance purpose without hindrance by supply conduits. The inlet conduits are located far from the outlet so that the grinding stock must pass through the entire grinding chamber. The supply nozzles admit the constituents of paste into an area where the grinding stock is thoroughly stirred by the rotating stirrer which is advantageous because in this manner the newly introduced liquid is conveyed quickly to the point where it is needed, that is to say, the point where the dry powder or the grist replenishment enters the chamber. In addition, fresh grinding stock which is introduced into the chamber is quickly transported away from the inlet nozzle with thorough stirring of the grist so that room is made for introduction of fresh grinding stock and stoppage at this point is avoided.

These and further objects, features and advantages of the present invention will become apparent upon perusal of the following description with reference to the accompanying drawings which show, for purposes of illustration only, and embodiment of apparatus which can be utilized for the practice of our process.

DETAILED DESCRIPTION OF THE DRAWINGS

Figure 1:
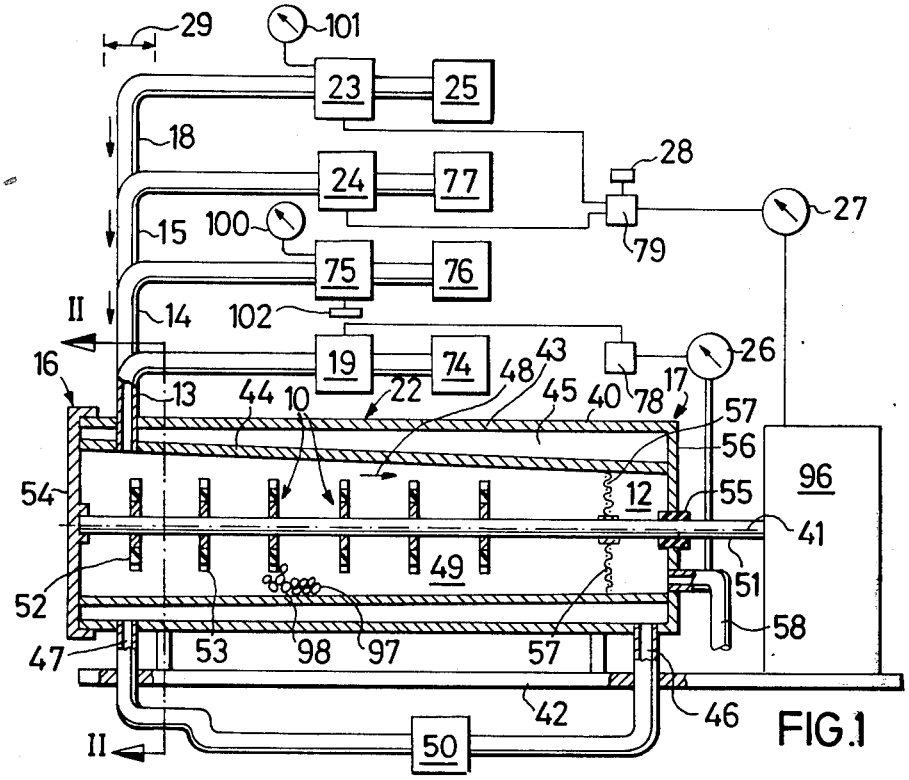
FIG. 1 is a cross-sectional view of a stirrer crushing mill for the practice of the novel process.

The stirrer crushing mill 22 comprises according to FIG. 1 a circular cylindrical casing 40 which has a horizontal axis 41 and is mounted on a small plate 42. The jacket of the casing 40 is double walled (the outer wall is marked 43 and the inner wall 44) so that it defines an annular cavity 45 which is connected to a cooler 50 by an inlet nozzle 46 and an outlet nozzle 47 and during operation, as far as necessary, is suffused with cooling water. The grinding chamber 49 is surrounded by the inner wall 44 and extends lengthwise in the direction of the axis 41 and crosswise so that it has a circular cross-section and tapers in the direction shown by arrow 48. The left-hand end of the grinding chamber 49 is closed by a removable cover 54. The grinding chamber 49 is equipped with a grinding tool 10, the shaft 51 of which extends coaxially to the casing 40, is journalled in the cover 54 and in the opposite end wall 56, extends from grinding chamber 49 through a pressure-tight and liquid-tight passageway 55 and is driven in the direction of arrow 11 (FIG. 2) by an electric motor 96.

Six grinding discs 52, 53 . . . are affixed to the grinding shaft 51 and consist of a rubbery elastic material such as plastic. The shaft 51 extends through a sieve plate 57 which separates an antechamber 12 from the grinding chamber 49. The outlet 58 for the paste communicates with this antechamber 12. The grinding chamber 49 is filled with grist 97, 98. The inlet end of the casing 40 is marked 16 and the exit end 17.

Four supply conduits convey constituents of paste into the grinding chamber 49. These include a supply conduit 13 for the liquid, a supply conduit 14 for the pulverized plant parts and supply conduits 15 and 18 for the particles of grist. The supply conduits are mounted close to the edge of the cover 54; with respect to the axis 41 they are mounted at the same distance from the inlet end 16 in an area 29. With respect to the direction of rotation of the grinding tool 10 according to arrow 11 and therefore also with respect to the direction of movement of the grist particles 97, 98, as shown by arrow 99, they are mounted in the sequence depicted in FIG. 2, whereby the supply conduit 13 for the liquid is situated first followed in the direction of rotation by the supply conduit 14 for plant powder which is followed by the supply conduits 15, 18 for the particles of grist. The discharge ends of the conduits follow each other closely in the circumferential direction so that the liquid introduced via conduit 13 is carried off by the grist in the joint area of the supply conduits 14, 15 and 18.

The supply conduit 13 is connected to a liquid source or tank 74 with the interposition of a pressure pump 19, the supply conduit 14 is attached to the pulverized plant source 76 with the interposition of an allotter or metering means 75, the supply conduit 15 is connected to a first source 77 of grist with the interposition of a grist allotter 24 and the supply conduit 18 is attached to a second source 25 of grist with the interposition of a grist allotter 23.

A capacity indicator continually measures the output capacity of the motor 96 and depending upon the measurement results, controls the grist allotters 23 and 24 with the interposition of a regulating instrument 79. The proportion of the necessary grist replenishment through the grist allotters 23 and 24 can be set by a device 28 on the regulating instrument 79. With the one extreme setting of the device 28 the entire grist replenishment from the source 77 occurs through the grist allotter 24 and with the other extreme setting the replenishment correspondingly is provided exclusively by the source 25. Using intermediate settings on the device, a mixed grist replenishment from both grist sources 77 and 25 is achieved, whereby the admixture rate can be set at any chosen proportion by the device 28. The total amount of the grist replenishment is not dependent on the setting of the device 28 and is solely dependent on the capacity measured by the capacity indicator 27.

A viscosity gauge 26 is attached to the outlet 58 and measures the viscosity of the outflowing paste and depending upon the measurement results regulates the pressure pump 19 with the interposition of a regulating instrument 78. A device 102 by means of which the distribution rate with which the plant powder is pressed into the grinding chamber 49 can be regulated is provided for the plant powder allotter 75. This distribution rate can be read off the indicator 100. The distribution rate with which the grist from the grist allotter 23 is pressed into the grinding chamber 49 can be read off the indicator 101.

During operation, the grinding chamber 49 is filled approximately 90 percent with grist having a diameter of between 3 and 5 mm and which only after having been ground down to a diameter of 0.3 mm can pass through the sieve plate 57 with the paste. The grist packing is saturated with water. The liquid tank 74 is filled with water; the plant powder source 76 contains about 50 to 100 $\mu$ finely ground dry plant powder. The grist source 77 contains glass beads with a diameter of 3 mm and the grist source 25 contains flint pebbles with a diameter of between 3 and 5 mm. The grindings of these flint pebbles are well suited as an adsorption material whereas the grindings of the glass beads are not. The grist packing in the grinding chamber 49 consists of one-third glass beads and two-thirds flint pebbles. The admixture rate is set at the proportion of 1 to 2 on the device 28 so that to one part glass beads always two parts of flint pebbles are added. The device 102 is to be set at a level based on experimentation. Now the stirrer crushing mill can be put into operation. The grinding tool 10 is now to be set in rotation and the liquid, pulverized plant parts and grist replenishment are to be pressed into the supply conduits 13, 14, 15 and 18 by the distributors 18, 75, 23 and 24 in the quantity to be set on each distributor. The liquid, together with the plant powder, passes through the grinding chamber 49 in the direction of arrow 48 — the movement direction — and is ground and blended in the process into a homogeneous paste and together with the grist grindings which have collected in the meantime leaves the grinding chamber 49 through the sieve 57 and flows out by way of the outlet 58 as a finished paste. If the paste contains too much liquid, the viscosity gauge 26 reduces the liquid supply at the pressure pump 19 and if the necessary capacity of the stirrer is too low, the capacity indicator 27 increases the amount of grist replenishment at the grist allotters 23 and 24.

When an equilibrium has been reached in the process, then the amount of plant parts and grindings from flint pebbles which flow out of the outlet in the paste during a time unit is the same as the amount shown on the indicators 100 and 101. If this proportion of grindings of flint pebbles to the plant parts in the finished paste is not at the desired level, a different mixture rate can be set by the device 28. If the amount of grindings of flint pebbles is too small, more flint pebbles and fewer glass beads are to be introduced and vice versa.

The mill can be operated exclusively with glass beads or with flint pebbles by regulating the device 28 accordingly. If the grinding is always to be done with only one type of grist, then one of the two grist allotters, together with its grist supply and supply nozzle as well as device 28, can be omitted.

The chemicals and other additives to be introduced into the paste to be formed are mixed into the paste leaving the outlet 58. The paste is then spread out into a foil and stabilized through the process of drying. Instead of this, it is also possible to dissolve the chemicals and additives, if they are soluble, in the liquid contained in the liquid tank 74, and if they are insoluble to admit them in a pulverized state into the plant powder source 76 or to levigate them into the liquid in the liquid tank 74.

Pump 19 is a pressure pump which pumps the liquid into the grinding chamber 49 at a pressure of 6 bar (atmospheric pressure). The liquid pressure inside the grinding chamber is in the range of 3 bar. The details of the powder distributor 75 and its supply conduit 14 are shown in FIG. 3.

The opening 80 of the supply nozzle 14 is provided in the inner wall 44 and a feed screw 84 mounted within the supply nozzle 14 ends at this opening. Mounted on the supply nozzle 14 is a funnel 82 which is the lower part of the container for the pulverized plant source 76. The shaft 83 of the screw 84 is connected to a motor 85, extending upwards out of the container for the pulverized plant source. The motor 85 therefore constitutes together with the screw 84 the distributor 75 and its speed can be set by the device 102.

Figure 3:
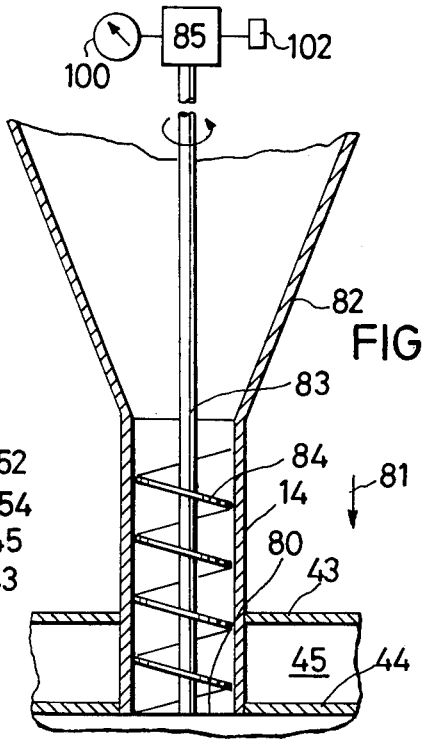

The allotters 23 and 24 for the grist together with their supply conduits 15 and 18 are constructed virtually exactly in the same way as the allotter and the supply conduit depicted in FIG. 3. However, it is advisable to coat the edges of the screw adjacent the supply conduit with hard rubber in order to avoid unnecessary friction of the grist at that point.

Figure 2:
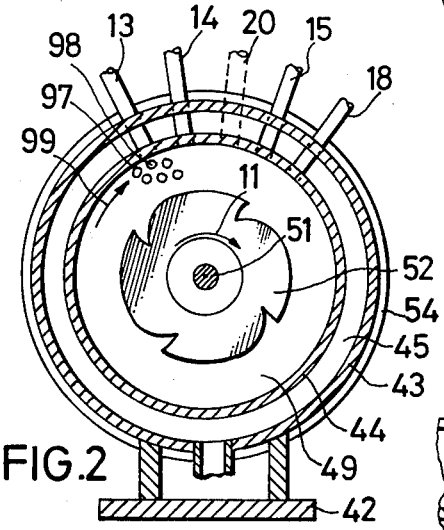
FIG. 2 is a view as seen in the direction of arrow II in FIG. 1, and FIG. 3 shown a powder allotter for the stirrer crushing mill of FIG. 1.

As shown by the dotted line in FIG. 2 a departure from the depicted operational example may be made by mounting an additional supply conduit 20 for liquid between the supply conduits 14 and 15, which is also fed by the pump 19 from the liquid tank 74 with a portion of the liquid to be introduced. In this manner the grist replenishment entering the chamber by way of the supply conduits 15 will be thoroughly moistened right from the start. Analogously, one can also provide an additional supply conduit for liquid in front of the supply conduit 18.

In an instance where the grinding procedure is to be carried out without using grist, the supply conduits 15 and 18 can be shut off or omitted together with the grist allotters 23 and 24 and the grist sources 25 and 77. In such a case during operation only the grinding stock consisting of plant parts and liquid which completely fills the grinding chamber 49 is to be found in the grinding chamber 49. The procedure is the same as with the use of grist except that the grinding stock can be drier than if grist is used; for one part by weight of dry substance 2 to 3 parts by weight of water suffice; the grinding tool 10 can be driven at a lower speed when using grist.

EXAMPLES

EXAMPLE 1

For the production of regenerated tobacco, dry pulverized tobacco discards of a size between 50 and 100 $\mu$, as is to be found in cigarette production, are introduced into the pulverized plant source 76. For every 10 kilograms of pulverized tobacco discards which enter the grinding chamber 49, 50 liters of water from the liquid tank 74 are introduced into the grinding chamber 49. Serving as grist, flint pebbles are continually introduced into the grinding chamber 49 by allotter 23 and glass beads with a diameter of 3 mm by allotter 24 in such an amount that the paste containing 50 liters of water for every 10 kilograms of tobacco discards which flows out of the outlet nozzle 58 consists of 700 grams of shavings from flint pebbles with a grain size of between 50 and 300$\mu$ and 50 grams of shavings from glass beads with a grain size of between 100 and 300 $\mu$. For every 10 kilograms of tobacco refuse, 200 grams calcium nitrate, 500 grams carboxy methyl cellulose and 800 grams glycerin are mixed into the paste. The paste is then spread out and stabilized into a foil through the process of drying.

EXAMPLE 2

It is the same as example 1 with the sole difference that no grist is introduced into the stock and that for every 10 kilograms of pulverized tobacco discards 30 liters of water instead of 50 liters are introduced into the grinding chamber 49 from the liquid tank 74.

What we claim is:

1. A process for the production of a paste which is to be converted into a smokable material, comprising the steps of continuously admitting pulverized plant parts and a liquid into one end of an elongated comminuting chamber at such a rate that the chamber is constantly filled to capacity, said admitting step comprising introducing the plant parts and liquid along separte paths but in close proximity to each other to insure thorough moistening of plant parts immediately after entry into the chamber; stirring the contents of the chamber and simultaneously comminuting the plant parts to thus convert the comminuted plant parts and the liquid into paste; and evacuating the paste at the other end of the chamber.

2. A process as defined in claim 1, wherein said stirring step includes moving the contents of the chamber in a predetermined direction, the locus of admission of liquid into said chamber being disposed ahead of the locus of admission of pulverized plant parts, as considered in said direction.

3. A process as defined in claim 1, further comprising the steps of admitting into said one end of said chamber particles of grist consisting of a material which, when present in the smokable material, is not injurious to the health of a smoker, the locus of admission of said particles of grist being closely adjacent the locus of admission of the liquid, said comminuting step including reducing the size of said particles by removing portions of such particles and said stirring step including intimately mixing the removed portions of said particles with other components of the contents of said chamber.

4. A process as defined in claim 3, further comprising the steps of monitoring the resistance which the contents of said chamber offer to stirring and regulating the rate of admission of grist as a function of variations of said resistance.

5. A process as defined in claim 1, further comprising the step of monitoring the viscosity of paste which issues from said chamber and regulating the rate of admission of liquid as a function of variations of said viscosity.

6. A continuous process for the production of a paste which is convertible into smokable material, comprising the steps of mixing a liquid, pulverized plant parts, particles of grist consisting of non-flammable adsorbent material and particles of nonadsorbent grist; simultaneously comminuting the pulverized plant parts and the adsorbent and nonadsorbent particles of grist to thus convert the mixture into a paste which contains comminuted plant parts and comminuted adsorbent and nonadsorbent particles of grist; monitoring the resistance which the mixture offers to stirring; regulating the combined quantity of added adsorbent and nonadsorbent particles of grist as a function of variations in said resistance; and maintaining the ratio of comminuted adsorbent particles of grist in the paste within a predetermined range.

* * * * *